United States Patent [19]

Watanabe et al.

[11] Patent Number: 4,967,452

[45] Date of Patent: Nov. 6, 1990

[54] ATTACHING DEVICE FOR GARMENT FASTENER ELEMENT

[75] Inventors: Hirokazu Watanabe, Kurobe; Yoshihiro Kanzaka, Toyama, both of Japan

[73] Assignee: Yoshida Kogyo, K.K., Tokyo, Japan

[21] Appl. No.: 408,109

[22] Filed: Sep. 15, 1989

[30] Foreign Application Priority Data

Sep. 17, 1988 [JP] Japan ..... 63-122038

[51] Int. Cl.[5] ..... A44B 1/12

[52] U.S. Cl. ..... 24/94; 24/95; 24/113 MP

[58] Field of Search ..... 24/94, 95, 96, 108, 24/113 MP

[56] References Cited

U.S. PATENT DOCUMENTS

| | | | |
|---|---|---|---|
| Re. 32,500 | 9/1987 | Takata | 24/113 MP |
| 336,062 | 2/1886 | Palmer | 24/113 MP |
| 618,868 | 2/1899 | Hall | 24/95 |
| 1,752,420 | 4/1930 | Clark et al. | 24/94 |
| 1,798,237 | 3/1931 | Warner et al. | 24/95 |
| 1,930,611 | 10/1933 | Freter | 24/94 |
| 4,858,281 | 8/1989 | Watanabe et al. | 24/113 MP |

FOREIGN PATENT DOCUMENTS

| | | | |
|---|---|---|---|
| 0216081 | 4/1987 | European Pat. Off. . | |
| 3336564 | 4/1985 | Fed. Rep. of Germany . | |
| 485775 | 2/1918 | France . | |
| 2040886 | 1/1971 | France . | |
| 59-174012 | 11/1984 | Japan . | |
| 61-97905 | 6/1986 | Japan . | |
| 1249741 | 11/1986 | Japan | 24/94 |
| 63-103407 | 7/1988 | Japan . | |
| 739121 | 10/1955 | United Kingdom . | |
| 2139476 | 11/1984 | United Kingdom . | |

*Primary Examiner*—Victor N. Sakran

*Attorney, Agent, or Firm*—Hill, Van Santen, Steadman & Simpson

[57] ABSTRACT

An attaching device for attaching a fastener element to a garment fabric includes a stud body having an enlarged head and including a clinching member and a relatively thick reinforcing member joined with the clinching member and forming at least a part of the head, the clinching member having at least one shank extending substantially perpendicular to the head and adapted to be clenched with the fastener element. A cap is formed of a synthetic resin and injection-molded over at least a peripheral edge portion of the head. The stud body includes a cap-retaining portion in the form of a plurality of recesses formed in the peripheral edge portion of the head and held in locking engagement with the material of the molded cap for firmly retaining the cap in position against removal from, and rotation relative to, the head.

26 Claims, 17 Drawing Sheets

ATTACHING DEVICE FOR GARMENT FASTENER ELEMENT

BACKGROUND OF THE INVENTION

1. Field of the Invention

The present invention relates to an attaching device for attaching a fastener element of a snap button, a stud button or a hook-and-eye to a garment fabric, and more particularly to such an attaching device including a reinforcement member covered with a cap of a synthetic resin.

2. Description of the Prior Art:

There are known attaching devices of the type described which include a stud body having a cap member formed of a synthetic resin or a synthetic rubber. Typical examples of such known attaching devices are disclosed in Japanese Utility Model Laid-open Publication Nos. 59-174012 and 61-97905.

In the attaching device shown in the first-mentioned Japanese publication, the cap is fitted over one end of a metallic leg member of the stud body. The cap of the attaching device of the last-mentioned Japanese publication is detachably mounted on a head of the stud body. The disclosed attaching devices are disadvantageous in that the caps are likely to be removed from the stud body during the handling of the attaching devices. Another disadvantage is that the cap is cracked or dented and has a scar on its outer surface when the stud body is staked or clenched with a fastener element. This is due to a relatively thin reinforcement member disposed in the head on which the cap is fitted.

Another prior attaching device, as proposed in Japanese Utility Model Laid-open Publication No. 63-103407, has a thick rubber cap member which is mounted on a stud body for resiliently absorbing the clenching force applied thereto. Such thick cap is free from crack and scar but due to its large thickness and a great resiliency producible therefrom, the thick cap may cause an insufficient clenching between the attaching device and a fastener element.

SUMMARY OF THE INVENTION

With the foregoing drawbacks in review, it is an object of the present invention to provide an attaching device having a synthetic resin cap which is free from being cracked or marked with any acar on its outer surface even when the cap is relatively thin, which is firmly retained in position against removal from, and rotation relative to, a stud body, and which enables a sufficient clenching of the attaching device with a fastener element which then results in a firm attachment of the fastener element to a garment fabric.

According to the present invention, an attaching device for attaching a fastener element to a garment fabric includes a stud body having an enlarged head and including a clinching member and a relatively thick reinforcing member joined with the clinching member and forming at least a part of the head. The clinching member has at least one shank extending substantially perpendicular to the head and adapted to be clenched with the fastener element. A cap is formed of a synthetic resin and injection-molded over at least a peripheral edge portion of the head. A cap-retaining portion is disposed at the peripheral edge portion of the head and held in locking engagement with the material of the cap for firmly retaining the cap in position against removal from, and rotation relative to, the head. The cap-retaining portion may include a recessed portion of the reinforcing member, a recessed portion of an annular flange of the clinching member, a recessed portion of a ring-shaped retaining washer assembled with the reinforcing member and the clinching member and the combination thereof.

Many other advantages and features of the present invention will become manifest to those versed in the art upon making reference to the detailed description and the accompanying sheets of drawings in which preferred structural embodiments incorporating the principles of the present invention are shown by way of the illustrative example.

DETAILED DESCRIPTION OF THE PREFERRED EMBODIMENTS

Figure 1:
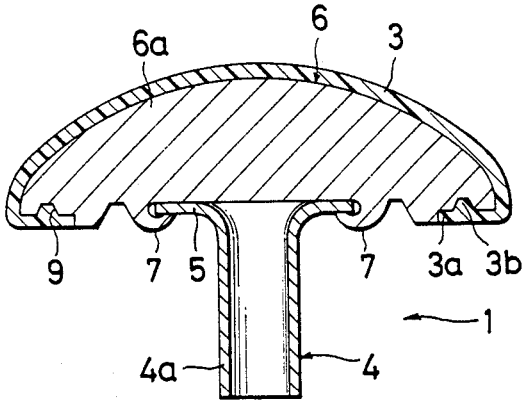
FIG. 1 is a cross-sectional view of an attaching device according to the present invention.
Figure 2:
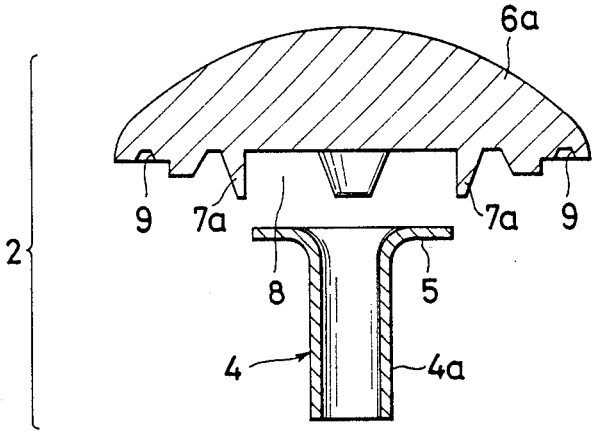
FIG. 2 is an exploded cross-sectional view of a stud body of the attaching device shown in FIG. 1.
Figure 3:
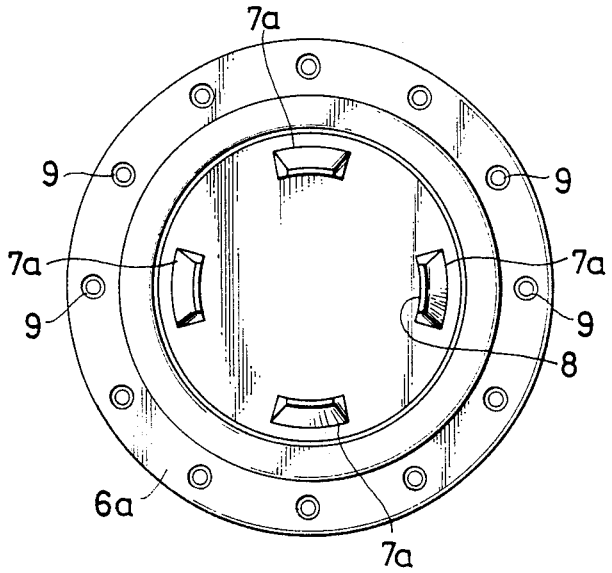
FIG. 3 is a bottom view of a reinforcement member of the stud body in FIG. 2.

Referring now to the drawings, wherein like reference characters designate like or corresponding parts throughout several views, FIGS. 1 through 3 show an attaching device 1 according to the present invention. The attaching device 1 includes a stud body 2 and a cap 3 fitted over an enlarged dome-shaped head 6 of the stud body 2.

The stud body 2 is composed of a clinching member in the form of an eyelet 4 and a reinforcing member in the form of a dome-shaped circular plate 6*a* solely constituting the dome-shaped head 6 of the stud body 2. The clinching member 6 is made of metal and has a tubular shank 4*a* and an annular flange 5 extending radially outwardly from one end of the shank 4*a*, the other end of the shank 4*a* being adapted to be clenched with a fastener element (not shown) such as a male or a female element of a snap button for attaching the fastener element to a garment fabric (not shown). The reinforcing member 6*a* is made of metal and has a relatively large thickness so that the reinforcing member 6*a* serves as an anvil plate when the fastener element and the shank 4*a* is clenched together. The reinforcing member 6*a* has on its flat under surface a plurality (four in the illustrated embodiment) of circumferentially spaced locking projections 7 clinched over a periphery of the flange 5 so as to join the reinforcing member 6*a* and the clinching member 4. The locking projections 7 prior to being clinched with the clinching member 4 are straight and upstanding from the under surface of the reinforcing member 6*a* so as to jointly define therebetween a substantially circular recess 8 for receiving therein the annular flange 5 of the clinching member 4. The reinforcing member 6*a* further has in its under surface a plurality of circumferentially spaced circular recesses 9 which serve as a cap-retaining portion of the stud body 6 for a purpose described later on. The cap-retaining portion in the form of the circular recesses 9 is disposed at a peripheral edge portion of the head 6. The cap 3 is formed of a soft or a rigid synthetic resin or synthetic rubber and injection-molded over the head 6 of the stud body 2. The injection-molded cap 3 is relatively thin and has a substantially uniform thickness over its entire area.

To produce the attaching device 1 shown in FIG. 1, the clinching member 4 is first placed on the central portion of the reinforcing member 6*a* with the annular flange 5 snugly received in the recess 8 defined by the upstanding locking projections 7*a*. Then, the locking projections 7*a* are bent radially inwardly of the reinforcing member 6*a* to clench the periphery of the flange 5, so that the clinching member 4 and the reinforcing member 6*a* are joined together to form a stud body (identical to the stud body 2 shown in FIG. 1). The stud body 2 is disposed in a mold cavity of a mold (not shown), the mold cavity having a shape complementary in contour to the shape of the attaching device 1 shown in FIG. 1. Thereafter, a synthetic resin material is injected into the mold cavity to thereby form a cap 3 fitted over the outer surface of the reinforcing member 6*a*. The injection-molded cap 3 has a peripheral edge 3*a* covering the peripheral edge portion of the head 6 including the circular recesses 9. During injection molding, the synthetic resin material flows into the recesses 9 with the result that the peripheral edge 3*a* of the cap 3 is formed with a plurality of projections 3*b* fitted in the respective recesses 9. Due to interlocking engagement between the recesses 9 and the projections 3*b*, the cap 3 is locked in position against removal from the reinforcing member 6*a* (namely, from the head 6) and also against the rotation relative to the reinforcing member 6*a*.

When a fastener element is attached by the attaching device 1 to a garment fabric, the shank 4*a* of the clinching member 4 is forced to drive through the garment fabric and then staked or clenched with the fastener element under an impact force Since the reinforcing member 6*a* is thick, the impact force applied to the shank 4*a* of the clinching member 4 is transmitted to the reinforcing member 6*a*, then distributed over the entire region of such thick reinforcing member 6*a* and substantially absorbed by the thick reinforcing member 6*a*. As a result, the cover 3 is prevented from cracking or being marked with scar notwithstanding the fact that the cover 3 is relatively thin.

Figure 4:
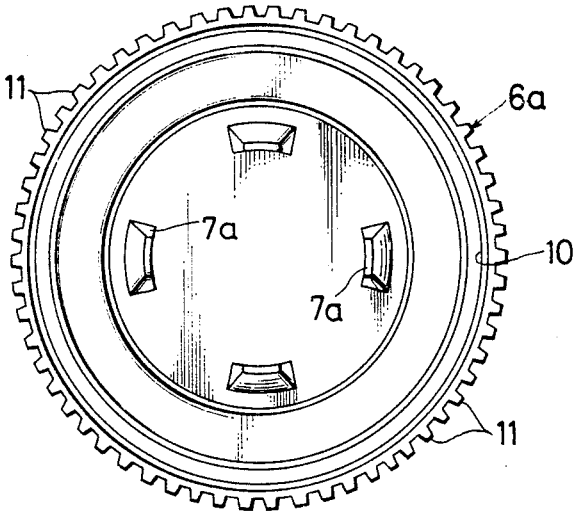
FIG. 4 is a view similar to FIG. 3, but showing a reinforcing member according to another embodiment.

A modified reinforcing member 6*a* shown in FIG. 4 is substantially the same as the reinforcing member 6*a* of the foregoing embodiment shown in FIGS. 1 through 3 with the exception that the cap-retaining portion is composed of an annular recess 10 extending in an under surface of the reinforcing member 6*a* along a peripheral edge of the reinforcing member 6*a*, and a series of teeth 11 provided on the peripheral edge of the reinforcing member 6*a*. The annular recess 10 serves to retain a cap (identical with the cap 3 shown in FIG. 1) in position on the retaining member 6*a* against removal therefrom while the teeth 11 prevents the cap from rotating relative to the reinforcing member 6*a*.

Figure 5:
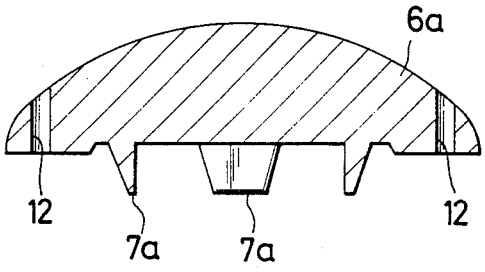
FIG. 5 is a cross-sectional view of a modified reinforcing member prior to being joined with a clinching member.

FIG. 5 shows another modified form of the reinforcing member 6*a* in which the cap-retaining portion is composed of a plurality of through-holes 12 extending through the thickness of the reinforcing member 6*a* adjacent to the peripheral edge of the reinforcing member 6*a* The cap-retaining portion in the form of the through-holes 12 is filled with a synthetic resin material of an injection-molded cap (identical with the cap 3 shown in FIG. 1) so that the cap is locked in position against removal from, and rotation relative to, the reinforcing member 6a.

Figure 6:
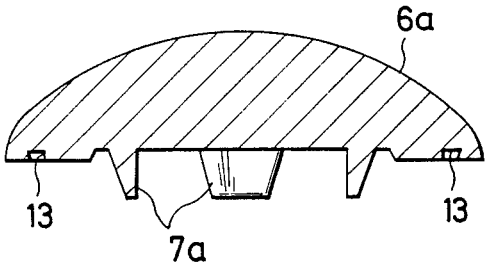
FIG. 6 is a view similar to FIG. 5, but showing another modified reinforcement member.
Figure 7:
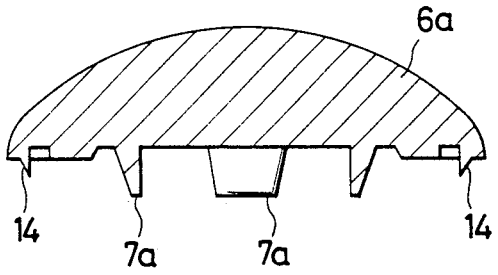
FIG. 7 is a view similar to FIG. 6, but showing the reinforcing member before a cap-retaining portion is formed.

A modified reinforcing member 6a shown in FIG. 6 is the same as the reinforcing member 6a shown in FIG. 3 except that the cap-retaining portion comprises a plurality of circumferentially spaced recesses 13 having a cross-sectional area which is greater at an open end than at a closed end. To form such tapered recesses 9, ridges 14 are first provided adjacent to circular recesses at one side thereof as shown in FIG. 7, then they are deformed or compressed by staking to project into the respective recesses toward the opposite side thereof An attachment device 1 shown in FIG. 8 is substantially the same as the attachment device 1 shown in FIG. 1 except that the clinching member 4 comprising a pronged fastening having a plurality of pointed shanks or prongs 4a extending perpendicularly from an annular base or flange 5.

Figure 9:
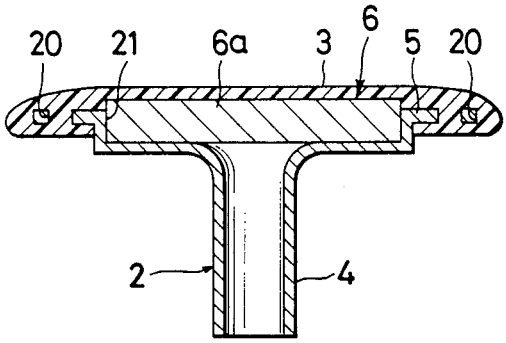
FIG. 9 is a cross-sectional view of a modified attaching device according to the invention.

FIG. 9 shows an attachment device according to another embodiment. The attachment device includes a cap-retaining portion which comprises a plurality of circumferentially spaced through-holes 20 disposed at an outer peripheral edge portion of an annular flange 5 of a clinching member 4 composed of an eyelet The flange 5 is stepped so as to provide a circular central recess 21 in which a reinforcing member in the shape of a circular disc 6a is press-fitted. The reinforcing member 6a and the outer peripheral edge portion of the stepped flange 5 extending radially outwardly from the reinforcing member 6a jointly constitute an enlarged head 6 of a stud body 2 of the attachment device. The through-holes 20 are filled with a synthetic resin material of a cap 3 which is injection-molded over the head 6 of the stud body 2, so that the cap 3 is firmly retained on the head against displacement.

Figure 10:
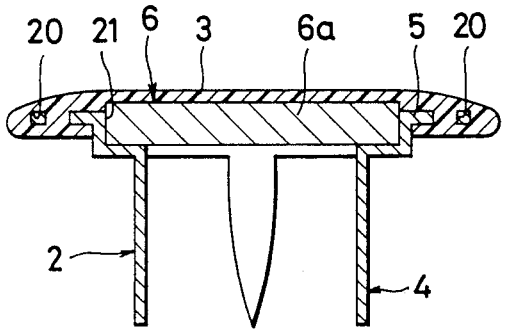
FIG. 10 is a view similar to FIG. 9, but showing another device having a pronged clinching member.

A modified attaching device shown in FIG. 10 is substantially the same as the attaching device shown in FIG. 9 with the exception that the stud body 2 includes a pronged fastening 4 in place of the eyelet.

Figure 8:
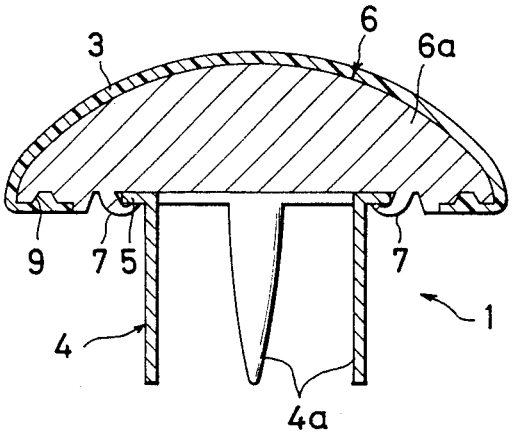
FIG. 8 is a view similar to FIG. 1 but showing an attaching device having a pronged clinching member.
Figure 11:
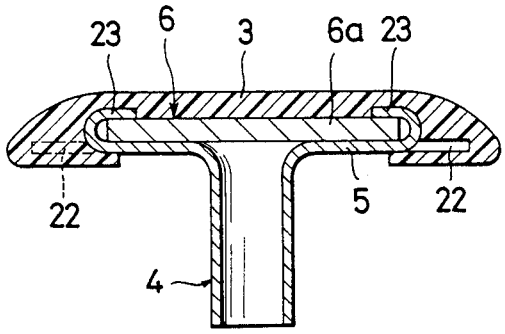
FIG. 11 is a cross-sectional view of an attaching device according to another embodiment of the invention.
Figure 12:
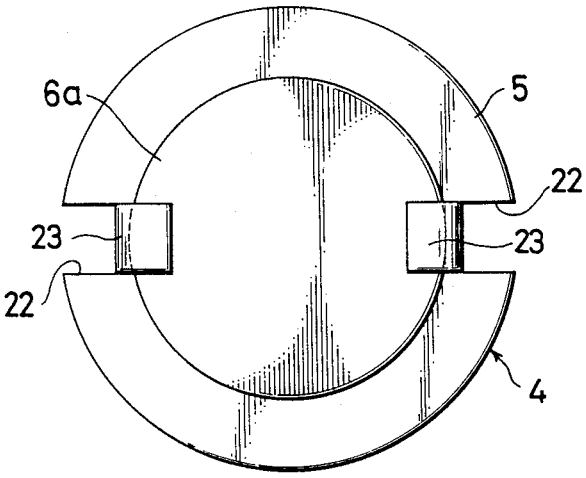
FIG. 12 is a plan view of a stud body of the attaching device shown in FIG. 11.
Figure 13:
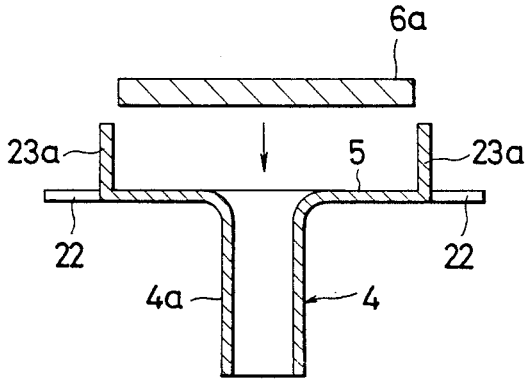
FIG. 13 is an exploded cross-sectional view of the stud body of FIG. 12, showing a clinching member and a reinforcing member as they are joined together.

An attaching device illustrated in FIG. 11 is similar to the attaching device shown in FIG. 8 but differs therefrom in that the reinforcing member 6a is retained on a flat annular flange 5 of the clinching member 4 by means of a pair of diametrically opposite grip fingers 23. The grip fingers 23 are punched from the flange 5 as designated at 23a in FIG. 13 and clinched over the periphery of the reinforcing member 6a as shown in FIG. 12, there resulting two corresponding cutout recesses 22 in the vicinity of an outer peripheral edge portion of the annular flange 5. The reinforcing member 6a and the outer peripheral edge portion of the annular flange 5 extending radially outwardly from the reinforcing member 6a jointly form an enlarged head 6 on which a cap 3 is injection-molded. Since the material of the injection-molded cap 3 is held in interlocking engagement with the cutout recesses 22, the cap 3 is firmly retained on the head 6 against detachment from the head 6 and also against rotation relative to the head 6. Thus, the cutout recesses 20 constitute a cap-retaining portion. The cap-retaining portion may further include a plurality of through-holes which are identical to the through-holes 20 shown in FIG. 9.

Figure 14:
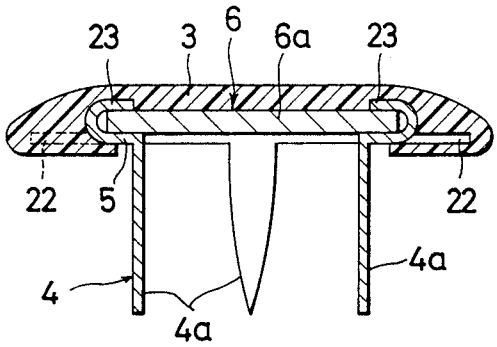
FIG. 14 is a view similar to FIG. 11, but showing a modified attaching device having a pronged clinching member.

FIG. 14 shows an attaching device which is the same as the attaching device shown in FIG. 11 except that the clinching member 4 comprises a pronged fastening including a plurality of prongs 4a extending perpendicularly from an inner peripheral edge of an annular flange 5.

Figure 15:
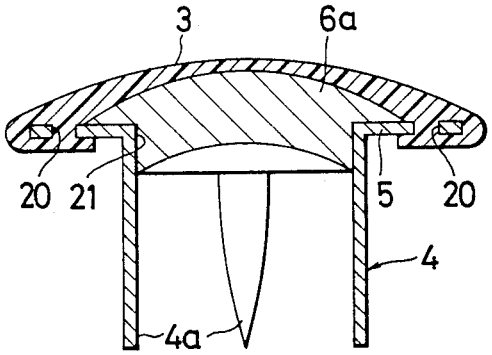
FIG. 15 is a view similar to FIG. 14 but showing another attaching device according to the invention.
Figure 16:
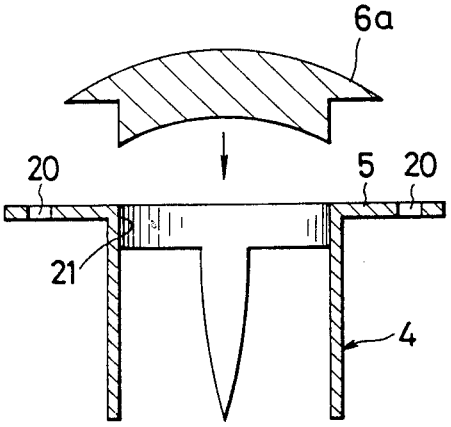
FIG. 16 is an exploded view of FIG. 15, showing a stud body prior to being assembled.
Figure 17:
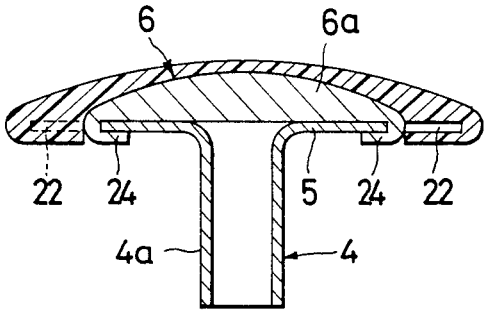
FIG. 17 is a cross-sectional view of a modified form of the attaching device according to the present invention.
Figure 18:
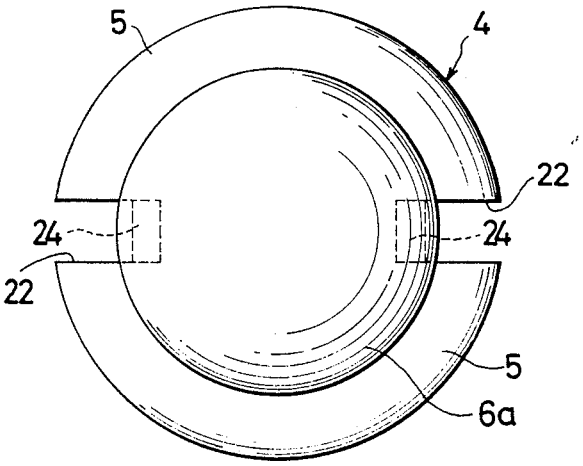
FIG. 18 is a plan view of a stud body of the attaching device shown in FIG. 17.
Figure 19:
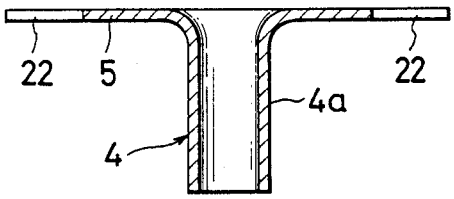
FIG. 19 is a plan view of a clinching member in the form of an eyelet of the stud body shown in FIG. 18.
Figure 20:
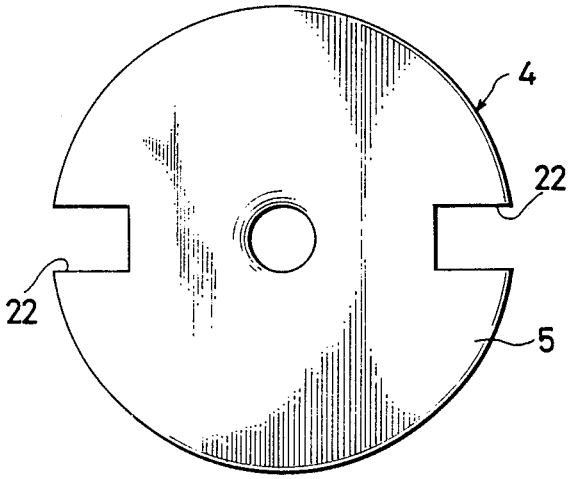
FIG. 20 is a plan view of the clinching member of FIG. 19.
Figure 21:
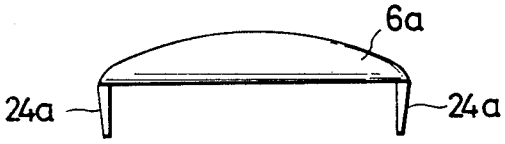
FIG. 21 is a front elevational view of a reinforcing member prior to being assembled with the clinching member shown in FIG 19.
Figure 22:
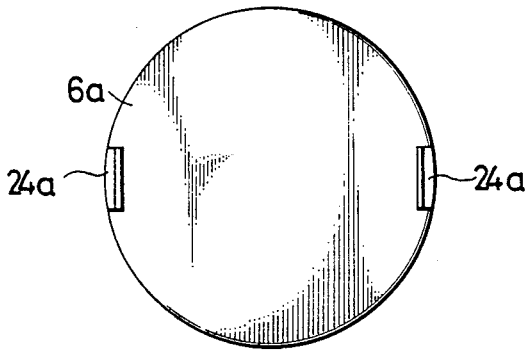
FIG. 22 is a bottom view of the reinforcing member shown in FIG. 21.

An attaching device shown in FIG. 15 is a modified variant of the attaching device shown in FIG. 10. The modified attaching device includes a hat-shaped reinforcing member 6a press-fitted in a circular central recess or hole 21 in a clinching member 4 in a manner as shown in FIG. 16. The clinching member 4 comprises a pronged fitting having a plurality of pointed shanks or prongs 4a extending perpendicularly from an inner peripheral edge of a flat annular flange 5. The annular flange 5 has a plurality of through-holes 20 disposed along an outer peripheral edge thereof at equal angular intervals The through-holes 20 constitute a cap retaining portion for retaining an injection-molded cap 3 in position against displacement FIG. 17 shows a modification of the attaching device shown in FIG. 11. The modified attaching device includes a clinching member 4 composed of an eyelet with a flat annular flange 5, and a reinforcing member in the shape of a dome-shaped circular plate 6a having a pair of diametrically opposed locking fingers 24 clinched over recessed outer peripheral edge portions 22 of the flange 5. The recesses 22 are formed by cutting out from the material of the flange 5 as shown in FIGS. 19 and 20. The locking fingers 24 prior to being clinched are straight and extending perpendicularly downwardly from a peripheral edge of the reinforcing member 6a, as designated at 24a in FIGS. 21 and 22. The upstanding locking fingers 24a are fitted in the respective cutout recesses 22 and then folded over and against an under surface of the flange 5 to thereby join the reinforcing member 6a and the clinching member 4 of a stud body. A cap 3 injection-molded of a synthetic resin is fitted over a head 6 of the stud body. The cutout recesses 22 constituting a cap-retaining portion are filled with the material of the molded cap 3 so that the cap 3 is locked in position against removal from the head 6 and also against rotation relative to the head 6. The cap-retaining portion may further include a plurality of through-holes which are identical to the through-holes 20 shown in FIGS. 9, 10 and 15.

Figure 23:
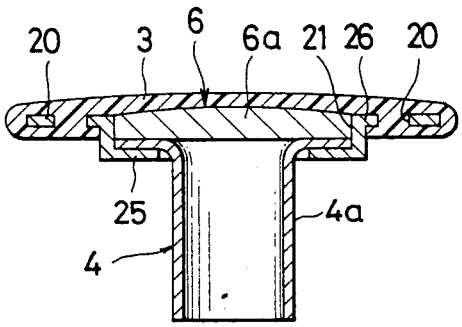
FIG. 23 is a cross-sectional view of a modified attaching device according to the present invention.
Figure 24:
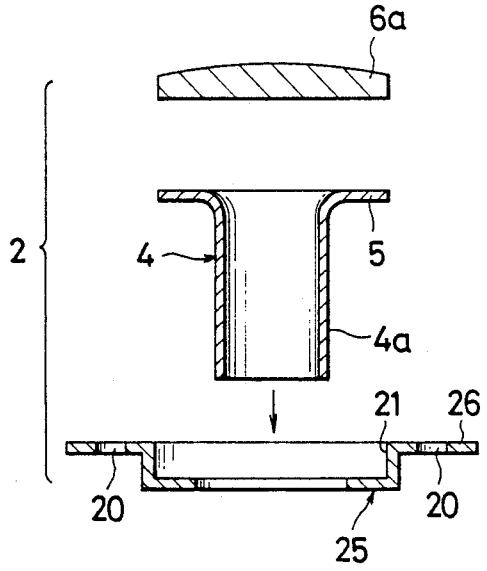
FIG. 24 is an exploded cross-sectional view of a stud body of the attaching device shown in FIG. 23.

An attaching device shown in FIG. 23 is similar to the attaching device shown in FIG. 9 but differs therefrom in that a stud body 2 is composed of three components, namely a circular reinforcing member 6a, a clinching member in the form of an eyelet 4, and a ring-shaped retaining washer 25, as shown in FIG. 24. The retaining washer 25 is stepped so as to provide a circular central recess 21 in which an annular flange 5 of the eyelet 4 and the circular reinforcing member 6a are firmly fitted in superposed relation. The reinforcing member 6a and the retaining washer 25 jointly constitute a head 6 of the stud body. The retaining washer 25 has a plurality of through-holes 20 formed in an outer peripheral edge portion 26 thereof at equal angular intervals. A plastic cap 3 injection-molded over the head 6 of the stud body is locked in position against displacement by means of a cap-retaining portion as the through-holes 20 are filled with the material of the molded cap 3.

Figure 25:
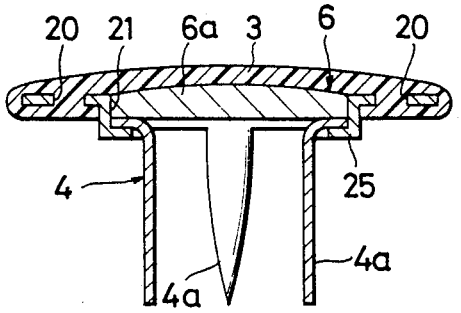
FIG. 25 is a view similar to FIG. 23, but showing another modified attaching device having a pronged clinching member.

FIG. 25 shows a modified attaching device which is substantially the same as the attaching device shown in FIG. 23 except that the clinching member is composed of a pronged fastening 4 instead of the eyelet.

Figure 26:
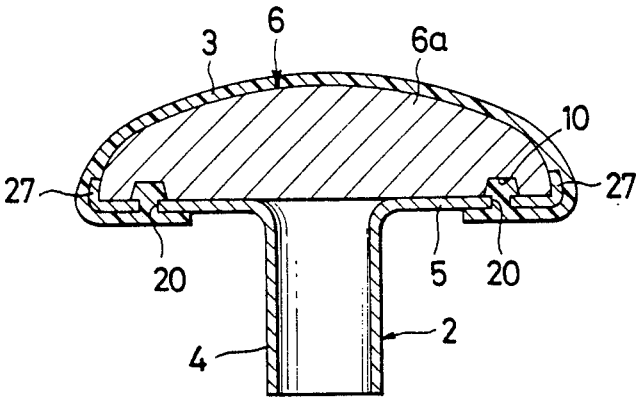
FIG. 26 is a cross-sectional view of another attaching device according to the present invention.
Figure 27:
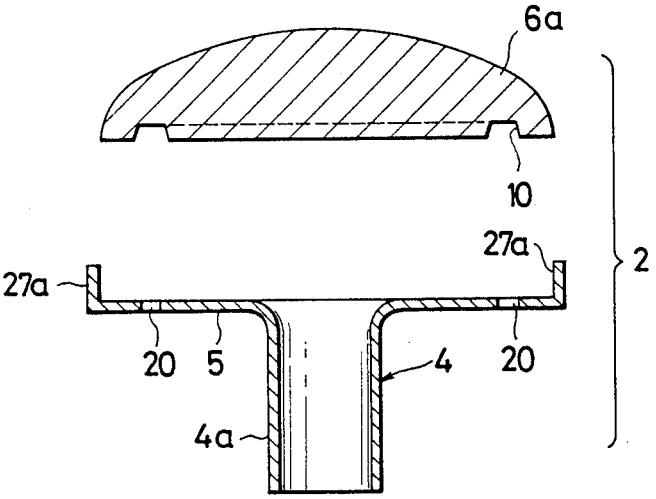
FIG. 27 is an exploded cross-sectional view of a stud body of the attaching device shown in FIG. 26.

An attaching device shown in FIG. 26 is similar to the attaching device shown in FIG. 1 but differs therefrom in that a dome-shaped reinforcing member 6a has in its flat under surface an annular recess 10 extending along the periphery of the reinforcing member 6a. The recess 10 has a trapezoidal shape in cross section. The reinforcing member 6a is joined with a clinching member 4 by means of a plurality (two in the illustrated embodiment) of locking legs 27 which extend upwardly from an outer peripheral edge of an annular flange 5 of the clinching member 4 and are clinched over the periphery of the reinforcing member 6a. The locking legs 27 prior to being clinched with the reinforcing member 6a are straight and upstanding from an outer peripheral edge of the annular flange 5, as shown in FIG. 27. The annular flange 5 has a plurality of circumferentially spaced through-holes 20 disposed in registry with the annular recess 10, the through-holes 20 having a diameter smaller than the width of the annular recess 10. The reinforcing member 6a and the annular flange 5 of the clinching member 4 jointly form an enlarged head 6 of a stud body 2 and the annular recess 10 and the through-holes 20 jointly constitute a cap-retaining portion of the head 6. The head 6 is covered with a cap 3 injection-molded of a synthetic resin. By the injection molding, the material of the cap 3 fills the through-holes 20 and the annular recess 10. Since the cap-retaining portion has a mushroom shape so that the cap 3 is locked in position against removal from the head 6 and also against rotation relative to the head 6. The cross-sectional shape of the annular recess 10 may be arcuate, a U-shape or a V-shape.

Figure 28:
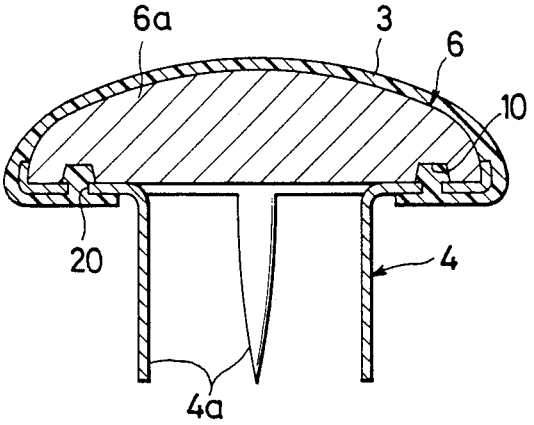
FIG. 28 is a view similar to FIG. 26, but showing a modified attaching device having a pronged clinching member.

FIG. 28 shows a modified attaching device which is substantially the same as the attaching device shown in FIG. 26 except that the clinching member comprises a pronged fastening 4 instead of the eyelet.

Figure 29:
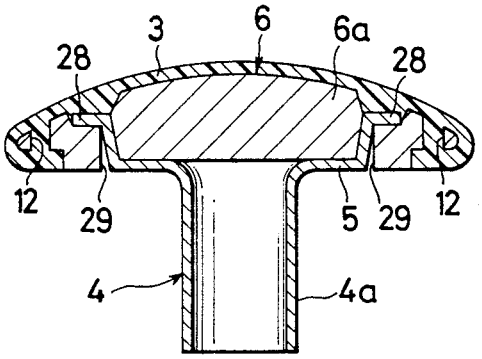
FIG. 29 is a cross-sectional view of a modified attaching device according to the present invention.
Figure 30:
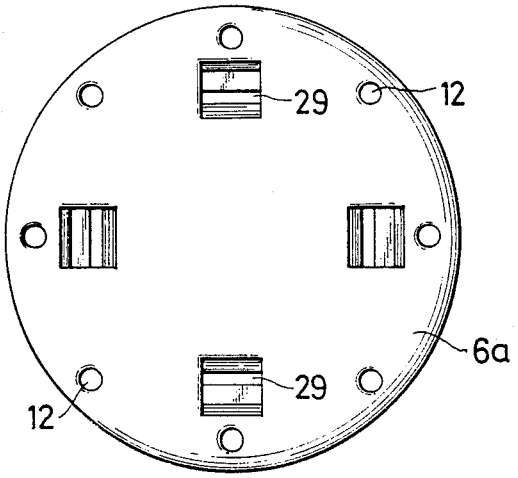
FIG. 30 is a bottom view of a reinforcing member of the attaching device shown in FIG. 29.
Figure 31:
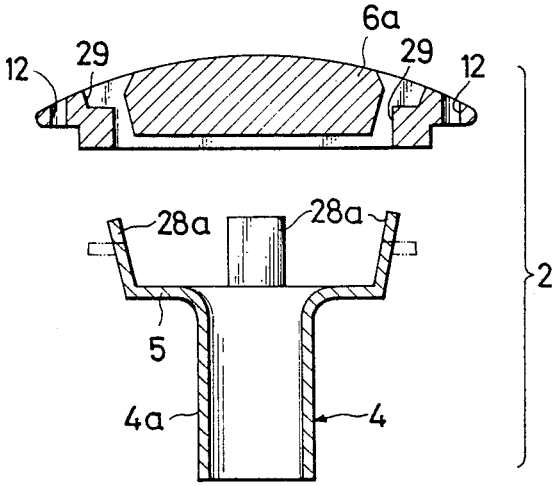
FIG. 31 is an exploded cross sectional view of the reinforcing member and a clinching member before they are assembled together.

A modified attaching device shown in FIG. 29 includes a stud body 2 (FIG. 31) composed of a generally dome-shaped reinforcing member 6a and a clinching member in the form of an eyelet 4 joined with the reinforcing member 6a. The clinching member 4 includes a tubular stem 4a and an annular flange 5 extending outwardly from an end of the stem 4a. The flange 5 has a plurality (four in the illustrated embodiment) of generally L-shaped locking legs 28 extending upwardly from an outer peripheral edge of the flange 5. The L-shaped locking legs 28 are firmly retained in stepped retaining holes 29 in the reinforcing member 6a. The locking legs 28 are initially straight as designated at 28a in FIG. 31, then they are inserted into the respective retaining holes 29 and finally clinched against stepped portions of the respective retaining holes 29 to thereby join the clinching member 4 and the reinforcing member 6a. The reinforcing member 6a has a plurality (eight in the illustrated embodiment) of through-holes 12 disposed in the vicinity of a peripheral edge of the reinforcing member 6a and extending through the thickness of the reinforcing member 6a. A cap 3 injection-molded of a synthetic resin is fitted over the reinforcing member 6a. By the injection-molding, the through-holes 12 are filled with the material of the molded cap 3, so that the cap 3 is firmly held in position against detachment from the reinforcing member 6a and also against rotation relative to the reinforcing member 6a.

Figure 32:
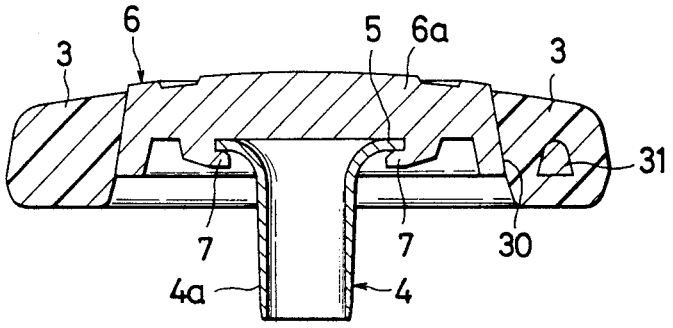
FIG. 32 is a cross-sectional view of a further modified form of the attaching device according to the present invention.
Figure 33:
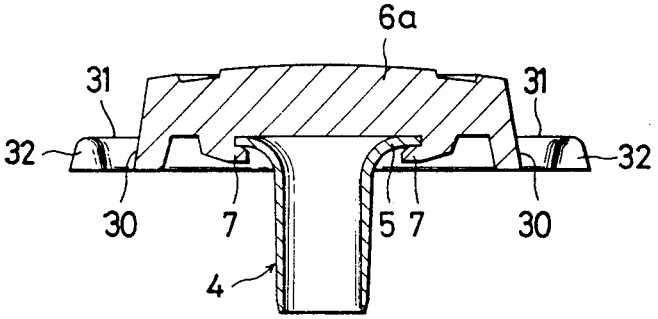
FIG. 33 is a cross-sectional view of a stud body of the attaching device shown in FIG. 32.
Figure 34:
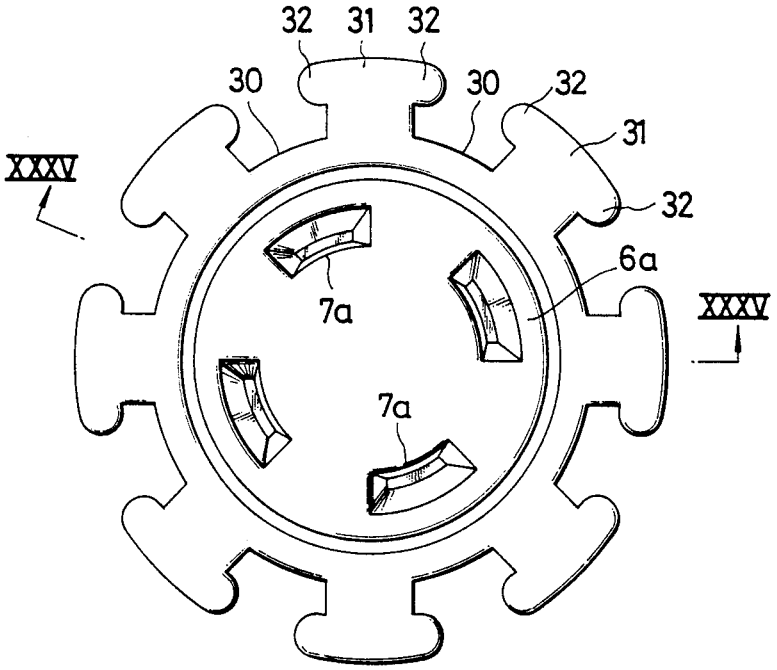
FIG. 34 is a bottom view of a reinforcing member prior to being assembled with a clinching member of the stud body shown in FIG. 34.
Figure 35:
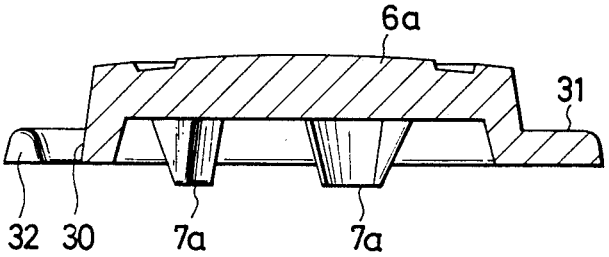
FIG. 35 is a cross-sectional view taken along line XXXV—XXXV of FIG. 34.

An attaching device shown in FIG. 32 includes a stud body having an enlarged head 6 and composed of a clinching member 4 and a reinforcing member 6a joined with the clinching member 4 and solely forming the head 6 of the stud body. The attaching device further has a cap 3 formed of a synthetic resin and injection-molded over a peripheral edge portion of the reinforcing member 6a. The clinching member 4 comprises an eyelet having an annular flange 5 extending outwardly from one end of a tubular shank 4a and clenched to the reinforcing member 6a by means of locking projections 7 of the reinforcing member 6. The locking projections 7 prior to being clenched with the periphery of the flange 5 are straight and extend perpendicular to the general plane of the reinforcing member 6a. The peripheral edge portion of the reinforcing member 6a is reduced in thickness and toothed so that there are provided alternate grooves 30 and teeth 31 disposed along the peripheral edge portion of the reinforcing member 6a. Each of the teeth 31 has a pair of lateral projections 32 extending in opposite directions from the distal end of each tooth 31. Since the injection-molded cap 3 is fitted over the toothed peripheral edge portion of the reinforcing member 6a, the grooves 31 are filled with the material of the molded cap 3. Consequently, the cap 3 is firmly retained in position against displacement with respect to the reinforcing member 6a. The cap 3 mounted exclusively on the periphery of the head 6 is less susceptible to abrasive wear than a cap fitted over the entire surface of head. An upper surface of the central portion of the reinforcing member 6a is exposed and may has an ornamental mark or character.

Obviously, various modifications and variations of the present invention are possible in the light of the above teaching. It is therefore to be understood that within the scope of the appended claims the invention may be practiced otherwise than as specifically described.

What is claimed is:

1. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said capretaining portion comprising a plurality of recesses formed in an under surface of said reinforcing member adjacent to a peripheral edge thereof and filled with the material of said injection-molded cap.

2. An attaching device according to claim 1, said recesses having a cross-sectional area greater at its open end than at its closed end.

3. An attaching device according to claim 1, said clinching member having an annular flange extending radially outwardly from one end of said shank, said reinforcing member having on its under surface a plurality of locking projections clinched over the periphery of said flange.

4. An attaching device according to claim 3, said clinching member comprising an eyelet having a tubular shank joined at its one end with said annular flange.

5. An attaching device according to claim 3, said clinching member comprising a pronged fastening having a plurality of prongs extending perpendicularly from an inner peripheral edge of said annular flange.

6. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said cap-retaining portion comprising an annular recess formed in an under surface of said reinforcing member and extending along a peripheral edge of said reinforcing member, and a series of teeth provided on the peripheral edge of said reinforcing member said annular recess and grooves defined between the adjacent teeth being filled with the material of said injection-molded cap.

7. An attaching device for attaching a fastener element to a garment fabric, comprising:

a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said caps retaining portion comprising a plurality of recesses formed in an under surface of said reinforcing member adjacent to a peripheral edge thereof and filled with the material of said injection-molded cap.

8. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said cap-retaining portion comprising a plurality of through-holes formed in the vicinity of a peripheral edge of said reinforcing member and extending through the thickness of said reinforcing member, said through-holes being filled with the material of said injection-molded cap.

9. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said cap-retaining portion comprising a series of teeth provided on a peripheral edge of said reinforcing member, each of said teeth having a pair of lateral projections extending in opposite directions into two adjacent grooves defined between the adjacent teeth, said grooves being filled with the material of said injection-molded cap, said reinforcing member having a plurality of stepped retaining recesses disposed inwardly of said through-holes, said clinching member having an annular flange extending radially outwardly from one end of said shank and a plurality of locking legs extending from an outer peripheral edge of said annular flange, said locking legs being received in the respective retaining and clinched with said reinforcing member.

10. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said clinching member having an annular flange extending radially outwardly from one end of said shank, said flange having an outer peripheral edge portion forming the peripheral edge portion of said head, said cap-retaining portion comprising a plurality of through-holes formed in said outer peripheral edge portion of said flange, said through-holes being filled with the material of said injection-molded cap.

11. An attaching device according to claim 10, said annular flange having a central recess, said reinforcing member being press-fitted in said central recess.

12. An attaching device according to claim 11, said clinching member comprising an eyelet having a tubular shank with an end joined concentrically with said annular flange.

13. An attaching device according to claim 11, said clinching member comprising a pronged fastening having a plurality of prongs extending perpendicularly from an inner peripheral edge of said annular flange.

14. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said clinching member having an annular flange extending radially outwardly from one end of said shank, said flange having an outer peripheral edge portion forming the peripheral edge portion of said head, said cap-retaining portion comprising a plurality of cutout recesses formed in said outer peripheral edge portion of said flange, said cutout recesses being filled with the material of said injection-molded cap.

15. An attaching device according to claim 14, said clinching member further having a plurality of grip fingers punched from said flange and clinched over the periphery of said reinforcing member.

16. An attaching device according to claim 15, said clinching member comprising an eyelet having a tubular shank joined at its one end with said annular flange.

17. An attaching device according to claim 15, said clinching member comprising a pronged fastening having a plurality of prongs extending perpendicularly from an inner peripheral edge of said annular flange.

18. An attaching device according to claim 14, said reinforcing member having a plurality of locking fingers disposed adjacent to a peripheral edge thereof, said locking fingers being held in locking engagement with the respective cutout recesses in said flange and clinched over an under surface of said flange.

19. An attaching device according to claim 14, said clinching member comprising an eyelet having a tubular shank joined at its one end with said annular flange 20. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said clinching member having an annular flange extending radially outwardly from one end of said shank, said study body further including a ring-shaped retaining washer having a central recess, said reinforcing member and said annular flange being firmly retained in said central recess in superposed relation, said retaining washer having a plurality of through-holes formed in an outer peripheral edge portion thereof, said through-holes being filled with the material of said injection-molded cap.

21. An attaching device according to claim 20, said clinching member comprising an eyelet having a tubular shank joined at its one end with said annular flange.

22. An attaching device according to claim 20, said clinching member comprising a pronged fastening having a plurality of prongs extending perpendicularly from an inner peripheral edge of said annular flange.

23. An attaching device for attaching a fastener element to a garment fabric, comprising:

(a) a stud body having an enlarged head and including a clinching member and a relatively thick reinforcing member joined with said clinching member and forming at least a part of said head, said clinching member having at least one shank extending substantially perpendicular to said head and adapted to be clenched with the fastener element;

(b) a cap formed of a synthetic resin and injection-molded over at least a peripheral edge portion of said head; and (c) a cap-retaining portion disposed at said peripheral edge portion of said head and held in locking engagement with the material of said cap for firmly retaining said cap in position against removal from, and rotation relative to, said head, said clinching member having an annular flange extending radially outwardly from one end of said shank and a plurality of locking legs clinched over the periphery of said reinforcing member, said cap-retaining portion comprising an annular recess formed in an under surface of said reinforcing member and extending along a peripheral edge of said reinforcing member, and a plurality of through-holes defined in said annular flange of said clinching member in registry with said annular recess, said annular recess and said through-holes being filled with the material of said injection-molded cap.

24. An attaching device according to claim 23, said through-holes having an diameter smaller than the width of said annular recess.

25. An attaching device according to claim 24, said clinching member comprising an eyelet having a tubular shank joined at its one end with said annular flange.

26. An attaching device according to claim 24, said clinching member comprising a pronged fastening having a plurality of prongs extending perpendicularly from an inner peripheral edge of said annular flange.

* * * * *